US008092746B2

(12) United States Patent
Salasc et al.

(10) Patent No.: US 8,092,746 B2
(45) Date of Patent: Jan. 10, 2012

(54) CATALYTIC PURIFICATION DEVICE

(75) Inventors: Sophie Salasc, Paris (FR); François Legat, Belfort (FR)

(73) Assignee: Faurecia Systemes d'Echappement, Nanterre (FR)

( * ) Notice: Subject to any disclaimer, the term of this patent is extended or adjusted under 35 U.S.C. 154(b) by 1106 days.

(21) Appl. No.: 11/661,133

(22) PCT Filed: Aug. 24, 2005

(86) PCT No.: PCT/FR2005/002134

§ 371 (c)(1),
(2), (4) Date: Oct. 30, 2007

(87) PCT Pub. No.: WO2006/027460

PCT Pub. Date: Mar. 16, 2006

(65) Prior Publication Data

US 2008/0138256 A1 Jun. 12, 2008

(30) Foreign Application Priority Data

Aug. 31, 2004 (FR) ..... 04 09230

(51) Int. Cl.
*B01D 50/00* (2006.01)
*F01N 3/08* (2006.01)

(52) U.S. Cl. ..... 422/117; 422/176

(58) Field of Classification Search ..... 422/168, 422/176, 177, 180

See application file for complete search history.

(56) References Cited

U.S. PATENT DOCUMENTS

| | | | | |
|---|---|---|---|---|
| 5,043,146 | A | 8/1991 | Ishikawa et al. | |
| 2002/0081244 | A1 * | 6/2002 | Roth | 422/179 |

FOREIGN PATENT DOCUMENTS

| | | |
|---|---|---|
| DE | 38 23 550 | 1/1990 |
| DE | 196 33 563 | 2/1998 |
| EP | 0318740 | 6/1989 |
| GB | 2236690 | 4/1991 |
| GB | 2236691 | 4/1991 |
| JP | 56 130217 | 10/1981 |

* cited by examiner

*Primary Examiner* — Tom Duong
(74) *Attorney, Agent, or Firm* — Young & Thompson

(57) ABSTRACT

A catalytic purification device including a substrate permeable to exhaust gases, is optionally impregnated with catalytic materials, and is provided with an upstream face and an opposing downstream face; and an envelope containing the permeable substrate and defining an enclosure provided with an inlet line and an outlet line, between which the permeable substrate is arranged, the upstream face of the permeable substrate projecting along the extension of the inlet line, and the axis of the inlet line defining, with the upstream face (14A), an angle smaller than 20°. The envelope includes a deflector arranged at the outlet of the inlet line, the deflector being inclined towards the upstream face and used to orient the exhaust gases escaping from the inlet line towards the permeable substrate. The envelope also includes elements for creating turbulence in the flow along the upstream face.

9 Claims, 3 Drawing Sheets

CATALYTIC PURIFICATION DEVICE

BACKGROUND OF THE INVENTION

Currently, exhaust lines for motor vehicles are provided with pollution control means and in particular devices for purification of exhaust gases, such as catalytic converters or particulate filters. These purification devices comprise, in a casing, a substrate which is permeable to exhaust gases, and which is optionally impregnated with catalytic substances which facilitate the conversion reaction of some polluting substances which are contained in exhaust gases.

Purification devices are commonly received in housings which are provided below the floor of the vehicle or in the engine compartment thereof. This housing sometimes has a small height and/or volume, with the result that it is complex to arrange the purification device at that location.

The substrates included in these purification elements are generally cylindrical having a circular cross-section. The length of the substrate measured between the upstream and downstream faces is often very much greater than the diameter of the upstream and downstream faces. In the case of a purification element which is placed below the floor, the substrate is arranged with the length thereof arranged horizontally so that the height of the cavity which receives the catalytic purification device must be greater than the diameter of the upstream and downstream faces of the substrate. In order to allow a purification element to be placed in a cavity having a small height, it was envisaged to use catalytic substrates which have a very small length and in contrast have very extensive upstream and downstream faces. The length is referred to as the thickness and these substrates are referred to as "pancakes" since they have a shape which is similar to a disc.

These substrates are arranged with their thickness very slightly inclined relative to the vertical. In order to allow the gases to flow, the inlet channel and the outlet channel of the catalytic purification device open with a slight incident angle practically tangentially relative to the upstream and downstream faces of the filter.

This type of catalytic purification device has low levels of efficiency in terms of pollution control, in particular owing to the unfavourable ratio between the small thickness of the filter and the large extent of the upstream and downstream faces, which limits the contact between the catalytic materials and the exhaust gases.

SUMMARY OF THE INVENTION

The object of the invention is to provide a purification device for exhaust gases in which the inlet and outlet channels extend almost tangentially relative to the upstream and downstream faces of the substrate but which allows optimised use of the surface of the substrate by the gases.

To this end, the invention relates to a purification device of the above-mentioned type, characterised in that the casing comprises, at the outlet of the inlet channel, a deflector which is inclined towards the upstream face and which is capable of directing the exhaust gases from the inlet channel towards the permeable substrate.

According to specific embodiments, the purification device comprises one or more of the following features:

the deflector extends opposite the front half of the upstream face of the permeable substrate arranged at the side of the inlet channel;

the casing comprises a shell which covers the upstream face of the substrate and delimits therewith a chamber in the continuation of the inlet channel, and the deflector is formed by a deformation of the shell which delimits, towards the inner side of the chamber, a face which is inclined towards the permeable substrate;

the deflector extends over the main part of the width of the substrate, the width extending transversely relative to the direction of the inlet channel;

the deflector is curved in the plane of the upstream face of the permeable substrate, the centre of curvature of the deflector being arranged opposite the inlet channel relative to the deflector;

the deflector extends from the inlet channel between a bottom portion which is remote from the upstream face of the permeable substrate and a top portion which is close to the upstream face, and the casing comprises, from the top portion, a level which extends along the upstream face of the permeable substrate towards the rear end of the upstream face;

the level has, in the direction from the deflector towards the rear end of the upstream face, means which are capable of creating turbulences in the flow along the upstream face;

the means which are capable of creating turbulences in the flow along the upstream face comprise a succession of transverse faces; and the thickness of the porous substrate measured between the upstream face and downstream face is less than half of the largest dimension of the upstream face of the permeable substrate.

BRIEF DESCRIPTION OF THE DRAWING

The invention will be better understood from a reading of the following description, given purely by way of example and with reference to the drawings, in which.

DETAILED DESCRIPTION OF THE PREFERRED EMBODIMENTS

Figure 1:
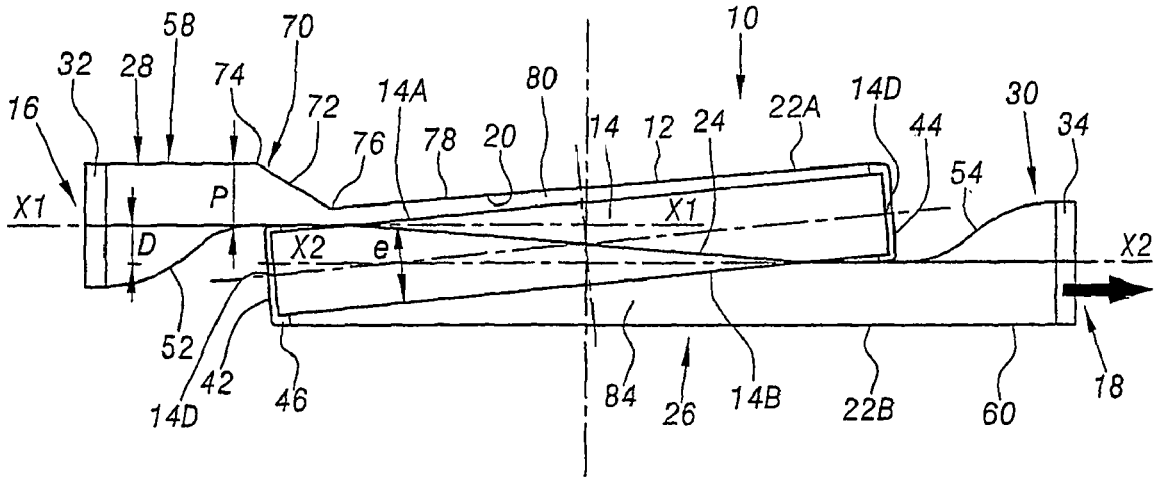
FIGS. 1 and 2 are a longitudinal section and top section, respectively, of a first embodiment of a purification device according to the invention.
Figure 2:
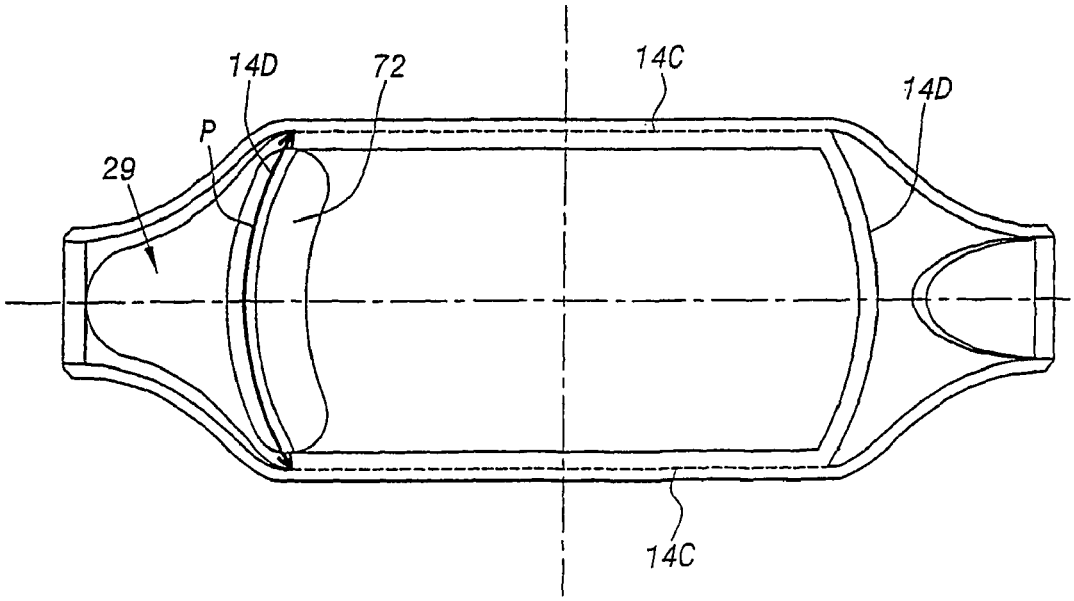

The purification device 10 illustrated in FIGS. 1 and 2 is intended to be fitted in an exhaust line of a motor vehicle which is equipped with a thermal engine. The purification device 10 comprises a casing 12 which delimits a closed space in which a substrate 14 is arranged. The casing 12 delimits an inlet 16 for admitting the exhaust gases and an outlet 18 for discharging the exhaust gases, between which the substrate 14 is arranged.

The substrate 14 is formed from a material which is preferably porous and permeable to exhaust gases. The substrate is optionally impregnated with catalytic materials. The substrate is formed, for example, from cordierite or silicon carbide, but it is conceivable to use a metal type substrate. Impregnating catalytic materials are, for example, those which are commonly used in 3-way catalysers, in oxidation catalysers or any other type of catalyser which can be used in an automotive application.

The substrate 14 has an upstream face 14A which is directed towards the inlet 16 and a downstream face 14B which is directed towards the outlet 18. The upstream and downstream faces extend parallel with each other and together delimit the thickness e of the substrate. The substrate is generally cylindrical, the bottom thereof being formed by either the upstream or downstream face. In the example given, these faces have a generally oblong shape with two parallel longitudinal walls 14C which are connected at the ends thereof by means of convex end walls 14D.

Advantageously, the thickness e of the substrate, that is to say, the distance which separates the upstream and the downstream faces, is less than half of the maximum dimension of the upstream face or the downstream face of the substrate. The dimensions (length and width) of the substrate are between 150 and 300 mm.

In particular, the thickness e is preferably between 20 and 60 mm. It is 40 mm in the example in question. The length of the filter is 320 mm and the width thereof is 150 mm.

The casing 12 delimits, between the inlet 16 and the outlet 18, a chamber 20 in which the substrate 14 is arranged. The casing is formed by two half-shells 22A and 22B which are assembled along a central longitudinal weld seam 24.

The two half-shells 22A, 22B together delimit a case 26 in which the substrate 14 is accommodated and a divergent portion 28 and convergent portion 30 which open in the case 26 and at the end of which the inlet 16 and outlet 18 are formed, respectively. These inlets and outlets are delimited by cylindrical channels 32, 34 which allow a tube of the exhaust line to be connected, in particular by means of welding.

The axes X1-X1 and X2-X2 of the channels 32, 34, respectively, extend parallel with each other and are offset along the height of the purification device by a small distance D of between 10 and 30 mm.

In the casing 26, the substrate 14 is inclined relative to the directions X1-X1 and X2-X2 of the inlet and outlet channels so that the centre plane thereof, which is parallel with the upstream face 14A and downstream face 14B, defines, with the axes of the channels 32, 34, a non-zero angle which is less than 20° and in particular equal to 6°.

The upstream face 14A and downstream face 14B, respectively, extend in the continuation of the channels 32, 34. Each half-shell comprises a lateral wall 42, 44 which is capable of conforming to the shape of a convex end wall 14D of the catalytic substrate 14.

A peripheral sealing joint 46 is interposed between the catalytic substrate 14 and the peripheral wall of the case 26. In particular, this joint is interposed between the lateral walls 42, 44 and the end walls 14D of the catalytic substrate 14.

The longitudinal walls 14C of the substrate press on longitudinal walls of the case which are delimited, in the case of one half, by one of the half-shells and, in the case of the other half, by the other half-shell, the connection plane extending substantially along a diagonal line relative to the lateral faces of the case.

The divergent portion 28 and convergent portion 30 are connected at their wide end to the case 26, at right-angles to the end walls 42, 44, along a passage P having a small height. This passage has a height which is substantially equal to half of the diameter of the channels 32 and 34. It extends over the entire width of the substrate 14 as illustrated in FIG. 2. The passage cross-section P is at least equivalent to two times the cross-section of the channels 32 and 34.

Each channel 32, 34 is extended along the divergent portion 28 and convergent portion 30 in the continuation of the lateral walls 42, 44 with a ramp 52, 54 which is connected to the edges of the lateral walls 42, 44 at the bottom of the passage P.

Furthermore, along the other face thereof, the divergent portion 28 and the convergent portion 30 are each delimited by a main solid face 58, 60 which widens from the inlet or the outlet and which extends parallel with the axes X1-X1 and X2-X2.

The passage P has a surface-area which corresponds to the projected surface-area of the corresponding face 14A, 14B of the substrate over the transverse section of the channel 34.

In this manner, the upper edge of the passage P opposite the lateral wall 42 extends substantially in the region of the opposite end of the upstream face 14A of the substrate.

According to the invention, a deflector 70 extends in the continuation of the inlet channel 32. This deflector 70 is inclined towards the upstream face 14A of the substrate 14 and is capable of directing the exhaust gases from the inlet channel 32 towards the substrate. This deflector 70 is arranged immediately downstream of the passage P and extends in the front half of the upstream face 14A of the substrate arranged at the side of the inlet channel 32.

Advantageously, the deflector 70 is provided in the first 20 percent of the upstream face 14A close to the inlet channel 32.

The deflector 70 is formed by a deformation of the upper shell 22A which delimits a ramp 72 whose bottom portion 74 extends in the region of connection to the planar main face 58.

The ramp 72 extends over the entire width of the upstream face 14A. It has a curved shape whose centre of curvature is arranged at the side opposite the inlet channel 32 relative to the ramp 72. This ramp defines, with the centre plane of the case parallel with the inlet channel 32, an angle of between 20° and 50°, preferably substantially equal to 30°.

The ramp 72 extends in the direction of the upstream face 14A of the substrate from the edge 74 which forms a bottom portion to an edge 76 which forms a top portion. The distance from the edge 76 to the upstream face 14A is between 15 and 5 mm and is preferably substantially equal to 10 mm.

Beyond the edge 76 of the top portion, the wall which delimits the half-shell 22A forms a smooth level 78 which extends substantially parallel with the upstream face 14A as far as the lateral end wall 44 in order to form a lamellar space 80. In the example in question, the level 78 is formed by a planar surface. This converges progressively towards the rear portion of the upstream face 14A in the direction of the end wall 44 so that the distance which separates the level 78 from the upstream face 14A is between 3 and 8 mm and in particular equal to 5 mm in the region of the rear portion of the upstream face 14A.

The half-shell 22B has the main face 60 which extends from the outlet channel 34 as far as the edge of the front end wall 42. In this manner, an outlet chamber 84 which has a cross-section which increases progressively towards the channel 34 is delimited between the main wall 60 and the downstream face 14B of the catalytic substrate.

With a purification device of this type, it is conceivable for the exhaust gases which penetrate into the casing 12 from the inlet channel 32 to be distributed over the entire cross-section of the passage P, flowing in the divergent portion 28. The ramp 52 guides the flow which arrives in the lower half of the channel 32 to the upper half of the divergent portion 38. The flow which is channeled in this manner, as soon as it enters the case 26, comes into contact with the deflector 70 and is thus deflected towards the front portion of the upstream face 14A. In this manner, a significant proportion of the exhaust gases penetrates into the substrate from this front portion of the upstream face 14A. The remaining exhaust gases flow between the level 78 and the remainder of the upstream face, being rolled in the circulation layer delimited between the level 78 and the upstream face 14A. In this manner, the other exhaust gases penetrate into the substrate progressively over the entire extent of the upstream face 14A. The decreasing cross-section of the lamellar space 80 promotes the penetration of the exhaust gases through the substrate 14.

It should be appreciated that, with a deflector of this type, the gases are restricted from first coming into contact with the front portion of the upstream face 14A of the substrate, thus allowing a distribution of the gas stream which is advantageous for better use of the useful surface-area of the upstream face of the porous substrate.

On the other hand, in the absence of a deflector of this type, the gases which arrive tangentially relative to the upstream face 14A penetrate firstly into the rear portion of the upstream face of the substrate and, in doing so, use only a small portion of the useful surface of this upstream face.

Figure 3:
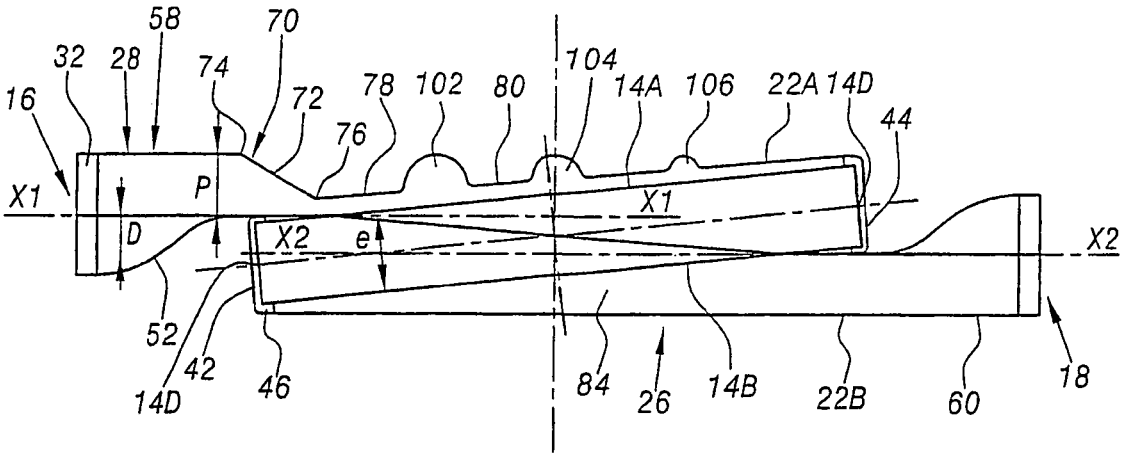
FIGS. 3 and 4 are views which are identical to those of FIGS. 1 and 2 of a production variant of the purification device of FIGS. 1 and 2.
Figure 4:
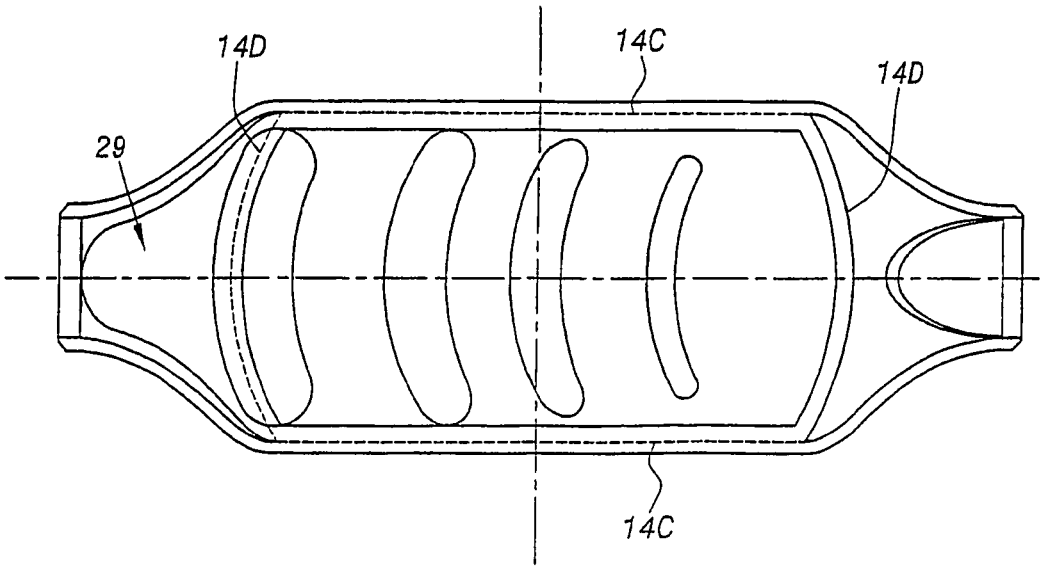
Figure 5:
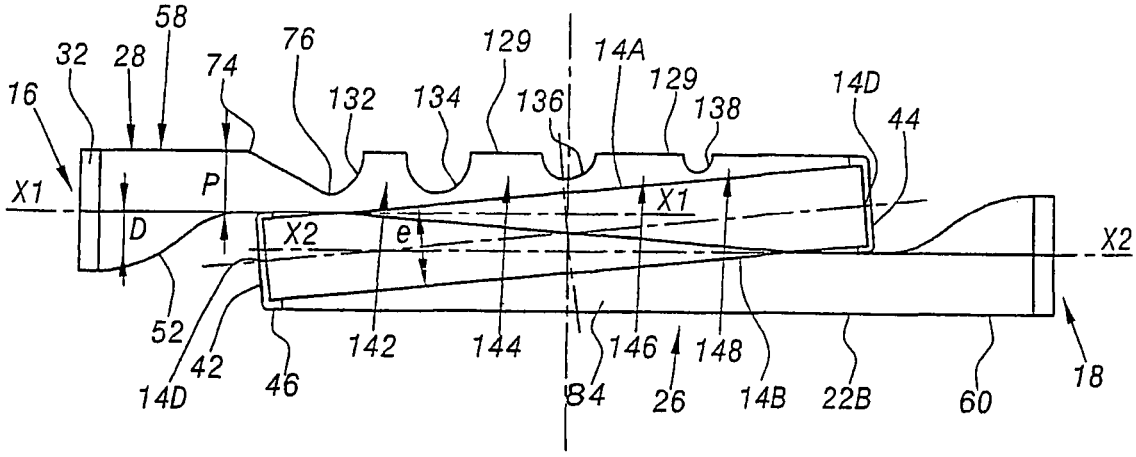
FIGS. 5 and 6 are views which are identical to those of FIGS. 1 and 2 of another production variant of the purification device according to the invention.
Figure 6:
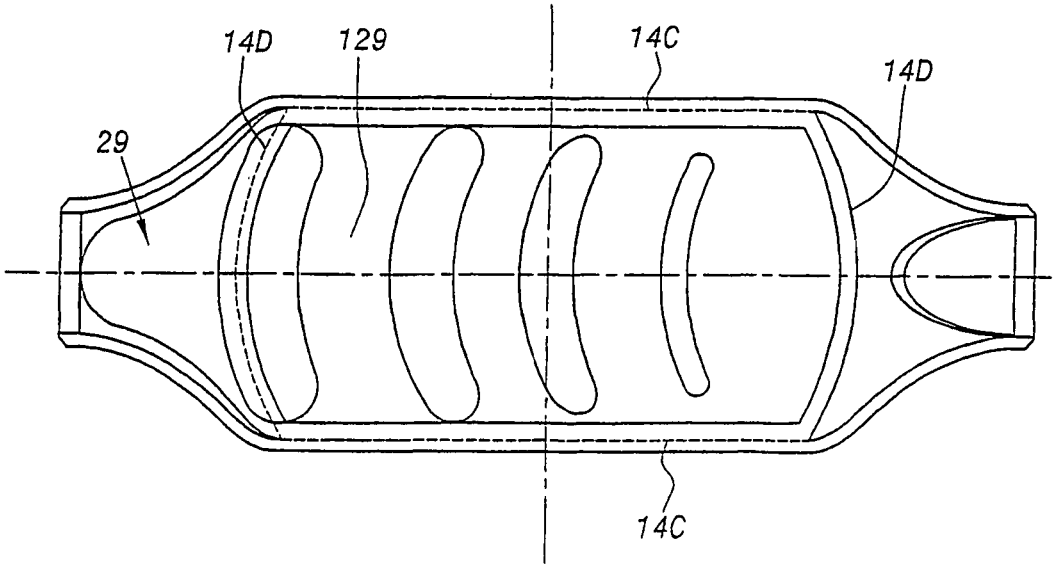

FIGS. 3 and 4, on the one hand, and FIGS. 5 and 6 illustrate production variants. In these alternative embodiments, elements which are identical or similar to those of the embodiment of FIGS. 1 to 2 are given the same reference numerals.

In the embodiment of FIGS. 3 and 4, the level 78 is provided, from the edge 76 of the top portion of the deflector, with a succession of transverse channels 102, 104, 106 which open in the lamellar space 80 opposite the upstream face 14A of the catalytic substrate. These channels have a cross-section which becomes progressively smaller from the front end to the rear end of the upstream face 14A. They extend over the main part of the width of the upstream face 14A. They are formed by a deformation of the wall which forms the half-shell 22A.

These channels have, for example, a semi-circular cross-section and have a diameter of between 10 and 40 mm.

They form faces which are capable of creating a turbulence in the gas stream which flows in the lamellar space 80 which promotes the deflection of the gas stream towards the upstream face 14A of the catalytic substrate at right-angles to each channel.

In the embodiment of FIGS. 5 and 6, the planar main face 58 extends beyond the deflector 70 opposite the upstream face 14A via a planar surface which is designated 129. This is connected to the edge 76 of the top portion of the deflector by means of a curved member 132.

Furthermore, ribs 134, 136, 138 which are directed towards the upstream face 14A are formed in the planar face 129. These ribs extend along the main part of the width of the porous substrate. They delimit, together and with the deflector 70, transverse channels 142, 144, 146, 148 which allow the gas stream to flow over the entire surface-area of the upstream face 14A. The ribs 134, 136, 138 have, for example, a semi-circular cross-section and form means for creating turbulence in the gas stream which is formed downstream of the deflector 70. As above, these means for forming turbulence promote the penetration of the exhaust gases through the front portion of the upstream face 14A before the gases reach the rear portion thereof.

Of course, the means for forming turbulences may have forms which are different from that of the transverse ribs and may be constituted by localised deformations of the level 78, for example, in the form of "bowls" which have a small diameter and depth as they extend towards the rear portion of the upstream face 14A.

The invention claimed is:

1. A catalytic purification device (10), comprising:

a substrate (14) which is permeable to exhaust gases and has an upstream face (14A) and an opposing downstream face (14B); and a casing (12) which contains the permeable substrate (14) and which delimits a chamber (20) which has an inlet channel (32) and an outlet channel (34) between which the permeable substrate (14) is interposed, the upstream face (14A) of the permeable substrate (14) extending in a continuation of the inlet channel (32) along an axis of the inlet channel, the axis of the inlet channel delimiting, with the upstream face (14A), an angle of less than 20°, the upstream face (14A) having a front side toward the inlet channel (32) and a rear side opposite the inlet channel (32), said casing (12) comprising a shell (22A, 22B) which covers the upstream face (14A) of the substrate and delimits therewith a chamber in the continuation of the inlet channel (32), said casing (12) also comprising, at an outlet of the inlet channel (32), a deflector (70) formed by a deformation of the shell (22A, 22B) which delimits, towards an inner side of the chamber, a face (72) which is inclined towards the permeable substrate (14), the deflector (70) being inclined towards the upstream face (14A) and sufficient to direct the exhaust gases from the inlet channel (32) towards the permeable substrate (14), the deflector (70) extending entirely above a front half of the upstream face (14A) of the permeable substrate (14) arranged at a side of the inlet channel (32), and the deflector (70) extending from the inlet channel (32) between a bottom portion (74) remote from the upstream face (14A) of the permeable substrate (14) and a top portion (76) close to the upstream face (14A), and said casing (12) further comprising, from the top portion (76), a level (78) which extends along the upstream face (14A) of the permeable substrate (14) from the top portion (76) towards the rear side of the upstream face (14A), the level (78) being face-to-face with the upstream face (14A), and the level having, in the direction from the deflector (70) towards the rear side of the upstream face (14A), means (102, 104, 106; 142, 144, 146, 148) for creating turbulences in a flow along the upstream face (14A).

2. The catalytic purification device according to claim 1, wherein the deflector (70) extends over a main part of a width of the permeable substrate (14), the width extending transversely relative to a direction of the inlet channel (32).

3. The catalytic purification device according to claim 1, wherein the deflector (70) is curved in a plane of the upstream face (14A) of the permeable substrate (14), a centre of curvature of the deflector (70) being arranged opposite the inlet channel (32) relative to the deflector (70).

4. The catalytic purification device according to claim 1, wherein the means for creating turbulences in the flow along the upstream face (14A) comprise a succession of transverse faces (102, 104, 106; 142, 144, 146, 148).

5. The catalytic purification device according to claim 1, wherein a thickness (e) of the permeable substrate (14) measured between the upstream face (14A) and downstream face (14B) is less than half of a largest dimension of the upstream face (14A) of the permeable substrate (14).

6. The catalytic purification device according to claim 1, wherein the substrate (14) is impregnated with catalytic materials.

7. A catalytic purification device (10), comprising:

a permeable substrate permeable to exhaust gases, the permeable substrate having an upstream face (14A) and an opposing downstream face, the upstream and downstream faces of the permeable substrate extending parallel with each other; and a casing comprising a shell (22A, 22B) which covers the upstream face (14A) of the permeable substrate and delimits therewith a chamber containing the permeable substrate, the casing further delimiting an inlet channel extending along a first axis (X1) and an outlet channel extending along a second axis (X2), the first axis (X1) of the inlet channel and the second axis (X2) of the outlet channel extending parallel with each other and offset from each other in a direction of a height of the casing by a predetermined distance, the upstream face (14A) of the permeable substrate contained within the casing being oriented toward an inlet of the inlet channel, and the downstream face of the permeable substrate being oriented toward an outlet of the outlet channel, the upstream face (14A) of the permeable substrate extending in a continuation of the inlet channel along the first axis (X1) of the inlet channel, the permeable substrate being inclined relative to the first and second axes (X1, X2) such that a surface of the upstream face (14A) delimits, relative to the first axis (X1) of the inlet channel, an angle of less than 20°, the shell of the casing comprising, at an outlet of the inlet channel, a deformation that delimits, towards an inner side of the chamber, a face (72) that is inclined towards a front portion of the upstream face (14A), said deformation forming a deflector (70) sufficient to direct the exhaust gases from the inlet channel towards the permeable substrate, the front portion of the upstream face (14A) being arranged toward the inlet channel and in vertical registration with the deflector (70) and being opposite to a rear portion of the upstream face (14A), the rear portion of the upstream face (14A) being remote and opposite from the front portion and free of vertical registration with the deflector (70), and the casing further comprising an upper portion extending above and facing the upstream face (14A) of the permeable substrate from the top portion (76) towards the rear side of the upstream face (14A), the upper portion comprising means for creating turbulences in a flow along the upstream face (14A).

8. The catalytic purification device according to claim 7, wherein the upper portion extends substantially parallel with the upstream face (14A).

9. The catalytic purification device according to claim 7, wherein the upper portion comprises a succession of transverse channels.

* * * * *